US005813080A

United States Patent [19]

Hendren

[11] Patent Number: 5,813,080

[45] Date of Patent: Sep. 29, 1998

[54] TOWEL STRUCTURE

[75] Inventor: Ronald Hendren, Minnetonka, Minn.

[73] Assignee: Universal Technologies, Inc., Minnetonka, Minn.

[21] Appl. No.: 691,131

[22] Filed: Aug. 1, 1996

[51] Int. Cl.[6] ..... A47L 13/12; A47K 7/02

[52] U.S. Cl. ..... 15/209.1; 15/210.1; 15/227; 15/118

[58] Field of Search ..... 15/118, 208, 209.1, 15/210.1, 227

[56] References Cited

U.S. PATENT DOCUMENTS

| | | | |
|---|---|---|---|
| 2,968,825 | 1/1961 | Wetherby | 15/210.1 |
| 3,023,795 | 3/1962 | Denkert . | |
| 3,303,865 | 2/1967 | Ouimet . | |
| 3,406,419 | 10/1968 | Young . | |
| 3,675,264 | 7/1972 | Storandt | 15/227 |
| 3,965,955 | 6/1976 | Price . | |
| 4,493,866 | 1/1985 | Kim | 15/210.1 |
| 4,498,579 | 2/1985 | Brick . | |
| 4,516,616 | 5/1985 | Fesler | 15/209.1 |
| 4,662,415 | 5/1987 | Proutt . | |
| 4,667,716 | 5/1987 | Solheim et al. . | |
| 4,898,222 | 2/1990 | Gaffney . | |
| 5,009,327 | 4/1991 | Levison . | |
| 5,026,541 | 6/1991 | Lanier | 15/227 |
| 5,099,897 | 3/1992 | Curtin . | |
| 5,146,968 | 9/1992 | Meek . | |
| 5,203,390 | 4/1993 | Eckstein . | |
| 5,215,136 | 6/1993 | Flanders et al. . | |
| 5,398,424 | 3/1995 | Corcoran . | |
| 5,639,532 | 6/1997 | Wells | 15/209.1 |

FOREIGN PATENT DOCUMENTS

| | | | |
|---|---|---|---|
| 1130940 | 10/1956 | France | 15/118 |

*Primary Examiner*—Randall E. Chin
*Attorney, Agent, or Firm*—Nawrocki, Rooney & Sivertson, P.A.

[57] ABSTRACT

An improved hand-held towel structure suitable for cleaning and drying athletic apparatus and other implements in wet weather is described. The towel structure includes an outer layer of towel material having a first predetermined absorbency which is separated from an inner layer of wiping material having a second predetermined absorbency by a film layer that substantially inhibits transfer of water from the towel material to the wiping material. The improved towel structure is arranged such that the outer layer of towel material may be utilized for wiping and cleaning the athletic equipment or other implements, while the film layer inhibits transfer of any soil or water to the inner wiping layer. The structure substantially defines an inner pocket open at the bottom in which the athletic equipment or other implements can be inserted for further wiping and drying. Various structures for retaining the elements of the towel structure in position relative to each other are described.

22 Claims, 4 Drawing Sheets

TOWEL STRUCTURE

BACKGROUND OF THE INVENTION

1. Field of the Invention

This invention relates generally to the field of hand-held towel structures for use in cleaning and drying athletic equipment and other implements; and, more particularly, it relates to a towel structure that utilizes toweling having a high level of absorbency surrounding an inner wiping layer and separated by a substantially impervious film.

2. State of the Prior Art

It has long been recognized that it is desirable to clean and dry various athletic equipment and other implements that are utilized in wet or rainy conditions. These include cleaning and wiping the heads of golf clubs after each use, wiping the hands and grips of golf clubs prior to use, cleaning and wiping a football prior to each play in wet conditions, and the like. These uses are, of course, illustrative only, and cleaning and drying of many other types of implements can be contemplated. While some activities allow for the availability of multiple towels and substituting dry ones as the towels become wet, there are circumstances where the availability of multiple towels is not practical. In golf, for example, while one towel can readily be carried along with the bag and clubs, it is generally not expedient to carry multiple towels. Accordingly, in wet or rainy conditions, it can often occur that the towel becomes saturated with water and dirt, and is of little use in wiping the hands or grips of the golf clubs.

Many special purpose drying arrangements have been devised for use with specific types of athletic equipment. With regard to handles of golf clubs, various attempts have been made to develop closures for golf club handles utilizing a water proof outer material and a water absorbent material internal to the cover. Examples are shown in U.S. Pat. No. 5,203,390 to Eckstein and U.S. Pat. No. 4,662,415 to Proutt. While these disclosed devices may in fact dry the handle of an associated golf club, they suffer from operational problems of not readily removing dirt or debris and having to remove the cover each time the club is used and reinstall the cover at the end of use. The covers are themselves a distraction and are subject to being easily mislaid or lost. Further, as a permanent cover there is concern over time of cleaning the covers.

A number of structures have been shown with the purpose of covering golf club heads. It is quite characteristic of golf club head covers that there is an outer layer that is substantially impervious to water and an inner layer that may or may not be of moisture absorbent material. Examples of characteristic golf head covers are shown in U.S. Pat. No. 3,965,955 to Price in which the inner layer is a soft non-moisture absorbent material such as nylon, and U.S. Pat. No. 3,406,419 to Young in which the inner layer is an absorbent material such as lambs wool. It can be seen that both of these coverings are limited in their function and are not easily cleaned. Other examples of golf head covers are U.S. Pat. No. 4,667,716 to Solheim et al., U.S. Pat. No. 3,303,865 to Ouimet, and U.S. Pat. No. 3,023,795 to Denkert. These structures also show an outer covering with an inner liner, and are also of marginal value in cleaning and drying the golf club heads.

U.S. Pat. No. 5,215,136 to Flanders et al. illustrates a multi-purpose golf club head and ball washer arrangement. It illustrates a cover for protecting the head of a golf club, and an associated housing, capable of use in washing and drying golf balls. Multiple types of fabrics are utilized along with a moisture barrier to assure that water and detergent within the ball washing compartment is kept from the golf club head compartment. The structure described has little general application to towel structures and is of little value to dry or clean any object other than golf balls.

Various attempts in the prior art have been made to develop a combination towel and rain cover for a golf bag. For example, U.S. Pat. No. 5,099,897 to Curtin illustrates a golf bag cover having toweling on the inner surface and waterproofing material on the outer surface. The structure is of a size that it can be folded and held together by hook and pile fasteners until unfastened for use. In a similar structure, U.S. Pat. No. 4,498,579 to Brick illustrates another combination towel and rain cover for a golf bag having a plastic outer surface and a toweling inner surface. Neither of these structures provide a towel structure that readily allows cleaning and absorption of large amounts of water with a further ability to wipe the equipment dry. These structures are also difficult to clean after use.

The prior art has some specific towel structures ranging from the simplest in U.S. Pat. No. 5,146,968 to Meek, wherein a towel is simply removably affixed to a club head and available for wiping. The absorbent toweling is subject to the same disadvantage of any other toweling in that once it is wet, there is no ready way to further wipe the equipment.

U.S. Pat. No. 5,009,327 to Levison illustrates a towel structure wherein the towel is retained within a housing when not in use and can be deployed by simply pulling it out of the housing. While this would protect the towel during rainy weather, the towel is subject to becoming wet and sodden when used and does not provide any substantial advantage over any other towel that might be utilized.

A towel having a protective covering for use in wet weather is described in U.S. Pat. No. 5,398,424 to Corcoran, wherein toweling is folded within a waterproof housing and has a slot opening in which objects to be wiped can be inserted. This structure does protect the toweling from rain and external water, but is subject to the same concerns of the other toweling devices in that once the toweling is wet, there is no further drying action that it can accomplish.

To address the deficiencies of the prior art, this invention was developed to provide a towel structure that utilizes an outer layer of towel material having a first absorbency, to substantially encompass an inner layer of wiping material having a second predetermined absorbency, where the inner layer of wiping material is separated from the outer layer of towel material by an impervious film layer that substantially inhibits the transfer of water from the towel material to the wiping material. This structure allows sports equipment or other implements to be wiped free of dirt and water by the outer layer of towel material and to then be wiped dry by the inner layer of wiping material. The towel structure is such that the outer layer of towel material can be readily removed for cleaning and drying. These and other more detailed objects of the invention will become apparent to those skilled in the art from a consideration of the drawings and the description of the preferred embodiment.

SUMMARY OF THE INVENTION

The present invention provides an improved towel structure that can be hand-held and utilized to clean water, dirt, and debris from an item of athletic equipment or other instrument, and to further wipe it dry even in rain, snow, or other conditions involving moisture. The improved towel structure utilizes an external towel member that can function to remove water, dirt and debris from any item to be wiped.

The towel structure further includes an inner wiping member that is separated from the towel member by a film member interposed between them. The film member is substantially impervious to transfer of water and protects the wiping member from any water that may be absorbed by the towel member. A closure is provided whereby the towel structure forms a cavity defined by the surfaces of the inner wiping member, with the cavity having an opening at least at the bottom of the structure, and in some instances along at least one side of the structure. Fastening members are provided to fasten the towel member and the wiping member on opposite sides of the film member. The fastening can be fixed as by sewing, or may involve a selectively releasible fastening mechanism whereby the towel member can be detached for washing and drying. This configuration allows the item to be cleaned and dried to be initially cleaned and wiped by the towel member, and when inserted in the cavity to be more fully wiped by the wiping member.

In another aspect, the towel structure incorporates towel means having a first absorbency for providing the function of cleaning and absorbing water. A wiping means having a second absorbency is provided for providing a second drying function. A film means is positioned between the towel means and the wiping means for inhibiting transfer of water from the towel means to the wiping means. The improved towel structure is constructed such that the towel means surrounds the wiping means, while providing an opening that allows access to the wiping means. In one embodiment, the towel means, wiping means, and film means are affixed together forming the composite improved towel structure. In another embodiment, fastening means are provided for joining the film means to the towel means, thereby allowing removal of the towel means for cleaning and drying.

The present invention is thus an improved towel structure that has the advantages of providing a towel structure that can be utilized in rainy, snowy, or wet conditions to clean and dry items, as well as the hands of users of such items. It overcomes the disadvantages of various specific and special structures shown in the prior art both in functionality and the ability to clean and dry the towel structure. Further, in terms of cost and ease of use, the improved towel structure is superior to any of the prior art structures.

The present invention is thus an improved towel structure for cleaning and drying athletic equipment and other implements in rainy, snowy or wet conditions. Additional features of the invention and the advantages derived therefrom, and the various scopes and aspects of the invention will become apparent from the drawings, the description of the preferred embodiment of the invention, and defined in the claims.

DESCRIPTION OF THE PREFERRED EMBODIMENTS

Figure 1:
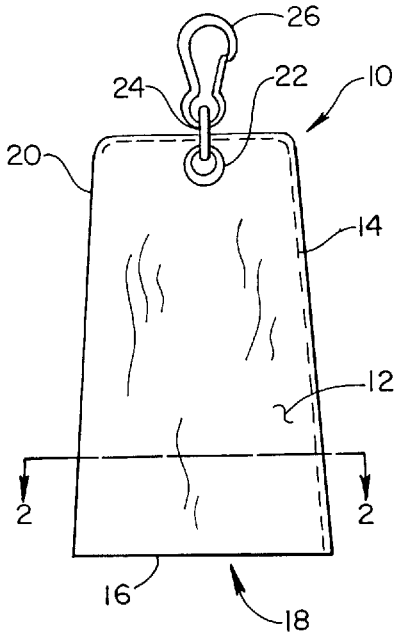
FIG. 1 is a side elevational view of the improved towel structure of the invention.

When referring to the drawings, like reference numerals will denote like elements throughout the various views.

FIG. 1 is a side elevational view of the improved towel structure of the invention. In this view, the towel structure 10 shows towel material 12 formed in a generally rectangular shape. A seam 14, shown in dashed lines, illustrates formation of a closure that is accessible at the bottom 16 upwardly into a cavity in the structure as shown by arrow 18. While the structure 10 could be totally rectangular, it has been found advantageous to have the top portion 20 somewhat narrower in width than the bottom portion 16. This facilitates turning the towel structure 10 inside out for cleaning of the inside of the closure, as will be described in more detail below. A grommet 22 encompasses an aperture near the top 20 of the towel structure. The grommet 22 can be affixed by ring 24 to a snap 26 for affixing towel structure 10 to the person of the user or to a supporting piece of equipment, such as a golf bag or golf cart.

Figure 2:
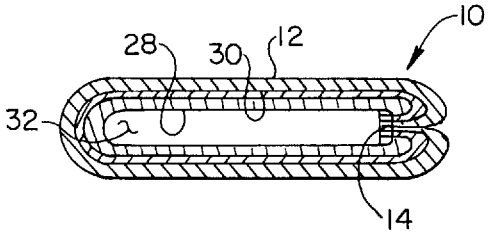
FIG. 2 is a cross-sectional view taken at line 2—2 in FIG. 1.

FIG. 2 is a cross-sectional view taken at line 2—2 in FIG. 1. In this view, the towel material 12 is illustrated encircling an inner wiping member 28 and a film member 30 interposed between wiping member 28 and towel member 12. The stitching 14 forms a seam at one marginal extremity of the towel structure 10. As constructed, the towel structure forms an inner cavity or closure 32.

In the preferred embodiment, the towel member 12 can be any substantially absorbent material, for example, tericloth or normal hand towel materials. The inner wiping member 28 is preferably substantially less absorbent than towel member 12, and should be capable of further drying action for items or hands brought in contact therewith. In this regard, a less absorbent fabric material could be used, but it has been found to be particularly advantageous for wiping member 28 to be a membrane. Chamois is particularly pliable and useful in wiping such things as golf club handles, footballs, leather gloves, and hands, as well as any other item that may be brought in contact with it. The film layer 30 is characteristically a lamina of plastic sheeting that is sufficiently strong to hold the wiping member 28 to the towel member 12, while being flexible enough to allow the towel structure 10 to have the feel of a normal hand-held wiping towel.

Figure 3:
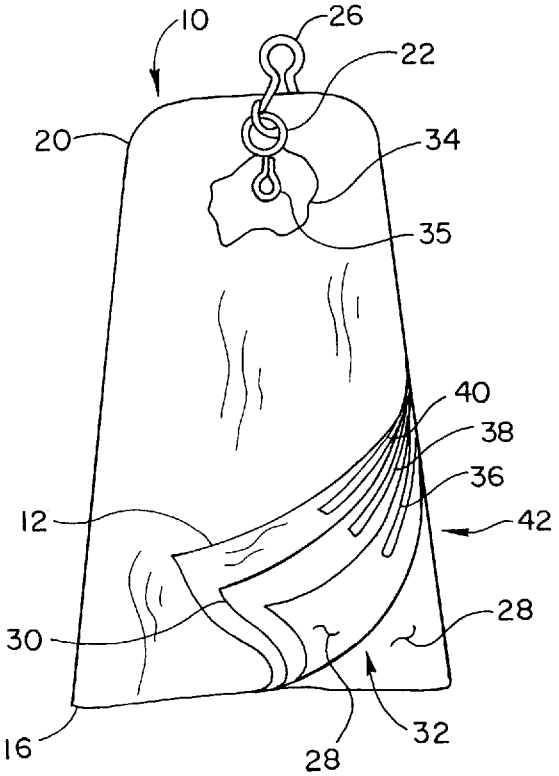
FIG. 3 is a side elevational view of the improved towel structure having a part broken away and showing layers of materials folded back.

FIG. 3 is a side elevational view of the improved towel structure having a part broken away and showing layers of materials folded back. In this view, broken away segment 34 exposes a loop 35 that is affixed in the vicinity of grommet 22 and is useful in grasping by a hand inserted upwardly in cavity 32 for pulling the towel structure 10 inside out. Turning it inside out is sometimes necessary for cleaning or drying the inner wiping member 28. With the top portion 20 slightly narrower than the bottom portion 16, the whole structure can be readily turned inside out. A snap 26 is shown engaging grommet 22 directly for mounting.

A portion of the towel structure 10 rolled back at the lower corner, illustrates the relationship of towel member 12 to the separating film 30 and the inner wiping member 28. The cavity or closure extends upwardly in the direction of arrow 32.

In this embodiment, the various elements are removably affixed to one another by mating fastening devices 36, 38 and 40, rather than the use of fixed structure provided by seam 14. The mating fastening structures can be constructed of known hook and loop mating members marketed under the trademark VELCRO. In this configuration, member 36 would be on the hidden side of wiping member 28 and would mate to the visible portion of the hook and loop fastening structure 38 on the underside of film member 30. The reverse side of film member 30 would have another mating portion (not shown) to mate with the portion of the connecting device 40 on the underside of towel member 12. It should be noted that the selectively detachable fastening devices do not extend clear to the bottom 16 of the structure, thereby allowing access to cavity or closure 32 from the side as illustrated by arrow 42.

It should, of course, be understood that film member 30 and wiping member 28 could be integrally formed by fixedly adhering a suitable wiping material directly to the film member 30. In such event, it would, of course, be unnecessary to have the wiping member otherwise affixed to the film member.

Figure 4:
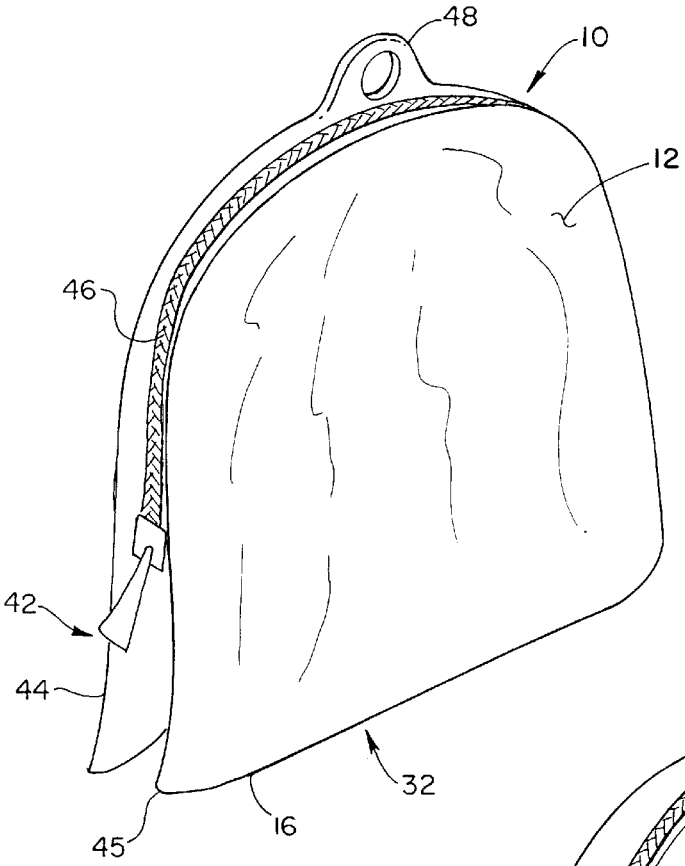
FIG. 4 is a pictorial view of the improved towel structure having a zipper to form a closure.

FIG. 4 is a pictorial view of the improved towel structure having a zipper to form a closure. In this configuration, the towel structure 10 has the towel member 12 joined at predetermined margins 44 and 45 by a zipper structure 46, such that the entire structure can be opened up to expose the inner wiping member (not shown). It should be noted that zipper 46 could be extended all the way to bottom 16, thereby forming a sleeve-like closure 32. As illustrated, however, zipper 46 does not extend completely to bottom 16 and allows access to closure 32 through the side vent in the direction of arrow 42. Rather than using the grommet 22, a mounting portion 48 is formed with the towel material 12 to allow the towel structure 10 to be supported. This also allows for the inner construction that permits the towel material 12 to be separated for cleaning and drying.

Figure 5:
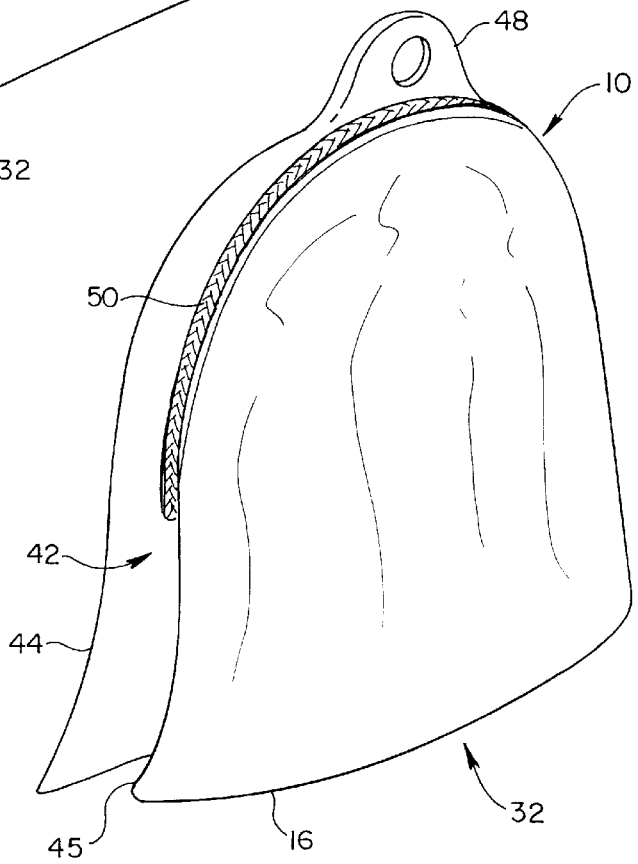
FIG. 5 is a pictorial view of the improved towel structure having a hook and loop fastener to form a closure.

FIG. 5 is a pictorial view of the improved towel structure having a hook and loop fastener to form a closure. This embodiment is similar to that described with regard to FIG. 4, with a different scheme that the structure is closed by a hook and loop fastener 50. For many applications, the hook and loop fastener 50 provides a physical structure that is more pliable and compliant than the use of a zipper 46. At the same time, it provides for a selectively actuatable mechanism to form the closure and cavity 32.

Figure 6:
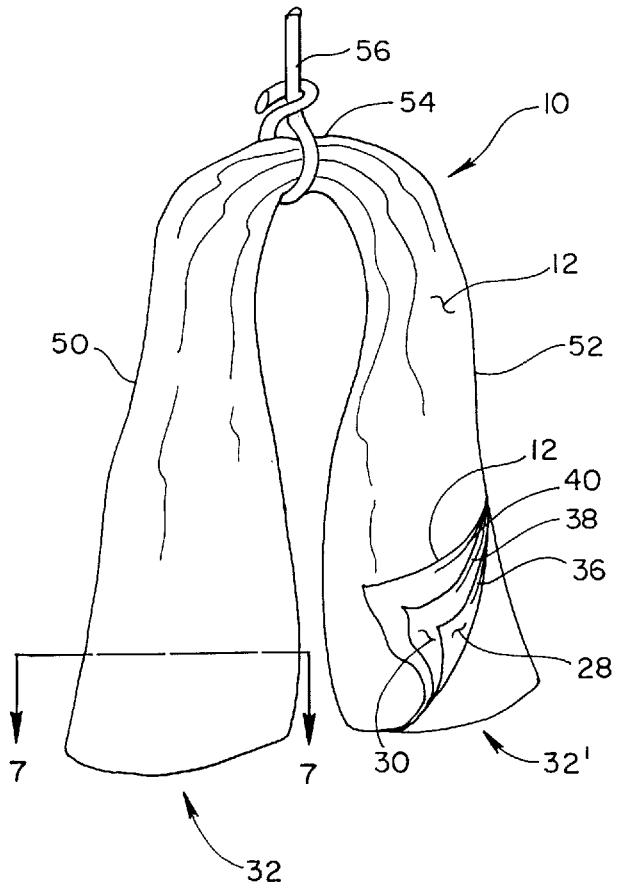
FIG. 6 is a pictorial view of an alternative embodiment of the improved towel structure.

FIG. 6 is a pictorial view of an alternative embodiment of the improved towel structure. In this configuration, the towel structure 10 is similarly formed in layers, but with an over-all length greater than the embodiments described above. In its total arrangement, this embodiment can be considered as a long tubular structure having internal closures 32 and 32' with access at the bottom of legs 50 and 52, respectively. A portion of leg 52 is illustrated folded back and separated such that the toweling structure 12 is shown separated from wiping layer 28 by film member 30. The hook and loop fastener structures 36, 38 and 40 are similar to those described with regard to FIG. 3. In this configuration, the towel structure 10 is essentially gripped substantially at its middle 54 along its length and held by a device 56 for supporting it. Device 56 can be fashioned from a length of cord, a fabric, or a mechanical clamping device. It is preferable that device 56 be subject to ease of release so that the towel structure 10 can be removed for cleaning and drying. This configuration has particular advantage in that with the legs 50 and 52 providing separate closures 32 and 32', respectively, that one leg can be utilized for equipment wiping until it becomes damp, and the other leg can be used for further wiping. This expands on the wiping surfaces available, while all of the wiping surfaces continue to be protected from water that may be absorbed in the toweling 12.

Figure 7:
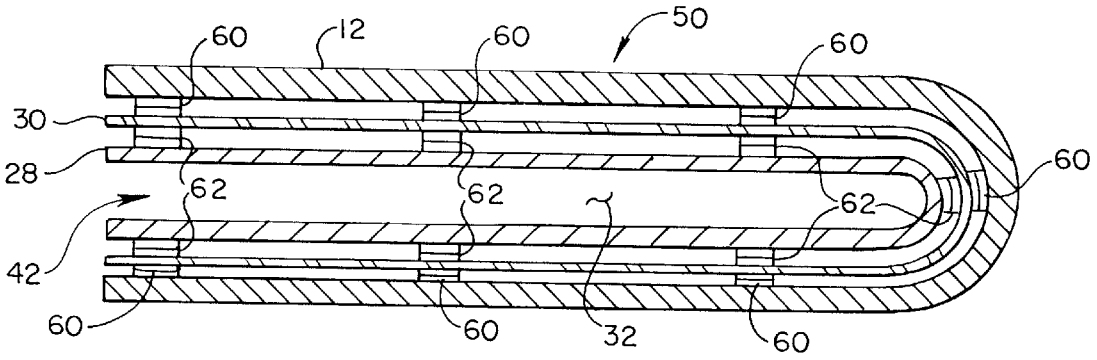
FIG. 7 is a cross-sectional view taken at line 7—7 in FIG. 6.

FIG. 7 is a cross-sectional view taken at line 7—7 in FIG. 6. This view illustrates the arrangement of layers in the lower portion of leg 50 where cavity or closure 32 is available from the side in the direction of arrow 42. Above this area, the upper portion of leg 50 would have closure 32 closed at its outer marginal locations. A number of hook and loop fasteners 60 are shown disposed between toweling material 12 and film member 30. These hook and loop fasteners can either be elongated strips or can be a series of individual fastener patches. In a similar manner, hook and loop fasteners 62 are shown disposed between wiping member 28 and film member 30, and holding these two members in a substantially fixed relationship with respect to each other. The number of hook and loop fasteners 60 and 62 can be adjusted to the relative weights of towel member 12 and wiping member 28, and need only be of a number sufficient to removably restrain the various layers. It is, of course, understood that if inner wiping member 28 is integrally formed with film member 30, that hook and loop fasteners 62 would not be required.

Figure 8:
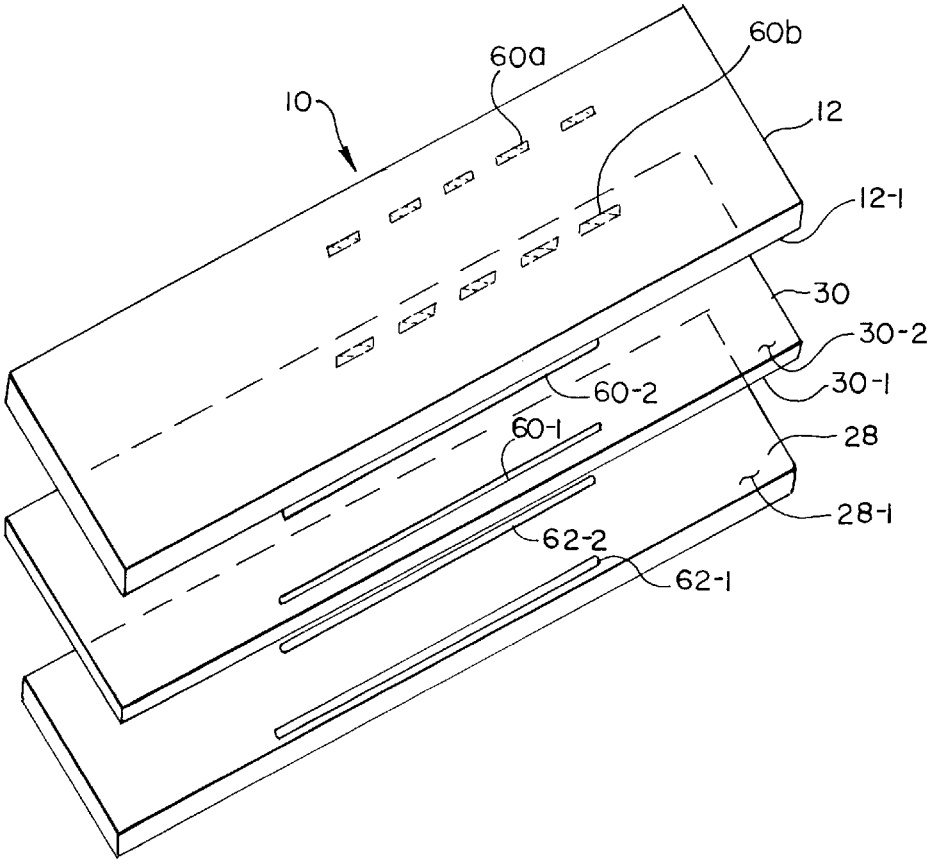
FIG. 8 is an exploded view of the layers of the improved towel structure.

FIG. 8 is an exploded view of the layers of the improved towel structure. In this configuration, toweling layer 12 is illustrated above film material 30, which in turn is illustrated above wiping member 28. Various combinations of the hook and loop fasteners are illustrated, the selection being dependent upon the use of the towel structure 10 and the relative weight of the materials of the various layers. For illustrative purposes, fastener element 62-1 is shown to be mounted to the upper surface 28-1 of wiping layer 28, and its mating portion 62-2 is adapted to be affixed to the under surface 30-1 of film layer 30. In a similar fashion, a portion of the fastening device 60-1 is adapted to be affixed to the upper surface 30-2 of film 30, while its mating portion 60-2 is to be affixed to the under surface 12-1 of toweling 12. When so affixed, and brought into contact, hook and loop fasteners 60 and 62 become engaged and hold the layers together.

Where the hook and loop fasteners 60 and 62 are not deemed necessary to be in continuous strips, a plurality of mating patches **60-*a* and 60-*b*** can be used in lieu of the continuous strips.

It should, of course, be understood that the hook and loop fasteners are one preferred alternative embodiment, but that other types of fasteners, such as snaps, hooks, buttons, or the like, could also be utilized.

It can be seen from the foregoing description of the preferred embodiments and the structures thereof that the objects of providing an improved towel structure for use in cleaning, drying, and wiping athletic equipment or other instruments in rainy, snowy, or wet conditions has been achieved. The system allows an outer toweling member to be utilized for cleaning and removing water from the items to be dried, and the inner wiping member to completely wipe and dry such items. The film member interposed between the towel and the wiping member prevents external moisture and dirt from passing through the towel member to the wiping member. Further, the various structures described allow for the entire towel structure to be either washed and dried as a unitary structure, or for the toweling member and/or the wiping member to be selectively removable for washing and drying.

Numerous characteristics and advantages of the invention have been set forth. It is understood that the description of the preferred embodiments are, in many respects, only illustrative. Changes may be made in details, particularly in matters of shape, size, and arrangement of parts without exceeding the scope of the invention. Having described the preferred embodiments in conjunction with the drawings, it can be seen that the various purposes and objectives of the invention have been achieved. It is also understood that there are modifications and extensions that will become apparent to those skilled in the art without exceeding the spirit and scope of the invention. Accordingly, what is intended to be protected by Letters Patent is set forth in the appended Claims.

What is claimed is:

1. A towel structure comprising:

a towel member formed in a first sleeve structure, said towel member having a first absorbency relative to water and having first and second ends;

a wiping member formed as a second sleeve structure having a second absorbency different from said first absorbency, and being substantially encompassed by said towel member;

a film member interposed between said towel member and said wiping member to substantially inhibit transfer of said water from said towel member to said wiping member; and a fastening mechanism fastening said towel member, said wiping member and said film member together.

2. A towel structure as in claim 1, and further including a closure mechanism for closing said first end.

3. A towel structure as in claim 2, wherein said fastening mechanism includes at least a first sewn seam; and said closure mechanism includes at least a second sewn seam.

4. A towel structure as in claim 1, wherein said fastening mechanism includes a first selectively actuatably fastener structure to allow separation of said towel member from said film member.

5. A towel structure as in claim 4, wherein said fastening mechanism includes a second selectively actuatably fastener structure to allow separation of said wiping member from said film member.

6. A towel structure as in claim 1, wherein said first end has a first width dimension and said second end has a second width dimension, said second width dimension being greater than said first width dimension.

7. A towel structure as in claim 1, wherein said wiping member is chamois.

8. A towel structure as in claim 1, wherein said wiping member and said film member are integrally formed.

9. A towel structure as in claim 1, wherein said first absorbency is substantially greater than said second absorbency.

10. A towel structure comprising:

towel means having a first absorbency for providing a first function including absorbing water;

wiping means having a second absorbency different from said first absorbency for providing a second function;

film means positioned between said towel means and said wiping means for inhibiting transfer of said water to said wiping means; and fastening means for joining said film means to said towel means and said wiping means in a predetermined configuration, said fastening means including closure means for causing said towel means and said film means to substantially enclose said wiping means in said predetermined configuration while allowing access to said wiping means to accomplish said second function.

11. A towel structure as in claim 10, wherein said fastening means includes zipper means for allowing said towel means to be removably affixed to at least a portion of said wiping means for allowing removal for cleaning or drying.

12. A towel structure as in claim 10, wherein said fastening means includes hook and loop fastener means for allowing said towel means to be removably affixed to at least a portion of said wiping means.

13. A towel structure comprising:

an outer layer of towel material having a predetermined length dimension, a first end having a first predetermined width dimension, and a second end having a second predetermined width dimension, said outer layer of towel material having a first predetermined absorbency characteristic relative to water;

an inner layer of wiping material having a second predetermined absorbency different from said first predetermined absorbency;

a film layer disposed between said outer layer of towel material and said inner layer of wiping material to substantially inhibit transfer of said water from said outer layer of towel material to said inner layer of wiping material; and a closure mechanism closing at least a portion of said predetermined length dimension and said predetermined width dimension at said first end, while leaving an opening at said second end to allow access to said inner layer of wiping material, whereby said inner layer of wiping material is maintained dry and useful to dry hands or sports equipment when said outer layer of towel material is wet.

14. A towel structure as in claim 13, and further including a fastening mechanism fastening said outer layer of towel material, said inner layer of wiping material, and said film layer together.

15. A towel structure as in claim 14, wherein said fastening mechanism includes sewn seams.

16. A towel structure as in claim 14, wherein said fastening mechanism includes selectively actuatable fastener structures to allow separation of said outer layer of towel material from said film layer and separation of said inner layer of wiping material from said film layer.

17. A towel structure as in claim 16, wherein said selectively actuatable fastener structure includes at least one pair of hook and loop devices affixed between said outer layer of towel material and said film layer to allow said outer layer of towel material to be readily removed for washing.

18. A towel structure as in claim 13, wherein said second width dimension is greater than said first width dimension.

19. A towel structure as in claim 13, wherein said inner layer of wiping material comprises chamois.

20. A towel structure as in claim 13, wherein said film layer comprises a lamina of plastic.

21. A towel structure as in claim 13, wherein said film layer and said inner layer of wiping material are integrally formed.

22. A towel structure comprising:

an outer layer of towel material having a predetermined length dimension, a first end having a first predetermined width dimension, and a second end having a second predetermined width dimension greater than said first width dimension, said outer layer of towel material having a first predetermined absorbency characteristic relative to water;

an inner layer of wiping material having a second predetermined absorbency different from said first predetermined absorbency;

a film layer disposed between said outer layer of towel material and said inner layer of wiping material to substantially inhibit transfer of said water from said outer layer of towel material to said inner layer of wiping material;

a closure mechanism closing at least a portion of said predetermined length dimension and said predetermined width dimension at said first end, while leaving an opening at said second end to allow access to said inner layer of wiping material, whereby said inner layer of wiping material is maintained dry and useful to dry hands or sports equipment when said outer layer of towel material is wet; and a grommet in proximity to said first end, and a fastener coupled to said grommet, whereby the towel structure can be affixed to a support for ready access.

* * * * *